United States Patent [19]

Maurer

[11] 4,054,399

[45] Oct. 18, 1977

[54] HYDRAULIC RAM VALVE UNIT

[76] Inventor: Alfred Maurer, Rankhofstrasse 30, 6006 Lucerne, Switzerland

[21] Appl. No.: 685,309

[22] Filed: May 11, 1976

[30] Foreign Application Priority Data

May 16, 1975 Switzerland ..... 6381/75

[51] Int. Cl.[2] ..... F04F 7/02

[52] U.S. Cl. ..... 417/226; 137/517; 251/65

[58] Field of Search ..... 417/226; 137/517, 480, 137/460, 479, 504; 138/46; 251/65

[56] References Cited

U.S. PATENT DOCUMENTS

| | | | |
|---|---|---|---|
| 337,112 | 3/1886 | Baer | 137/517 |
| 1,285,629 | 11/1918 | Crowe | 417/226 |
| 1,447,342 | 3/1923 | Dodson | 417/226 X |
| 1,706,920 | 3/1929 | Fusch et al. | 137/517 X |
| 1,710,214 | 4/1929 | Hassold | 137/517 X |
| 3,919,991 | 11/1975 | Neschke et al. | 251/65 |

*Primary Examiner*—William R. Cline
*Attorney, Agent, or Firm*—Flynn & Frishauf

[57] ABSTRACT

A ram valve is connected in the supply line through which water flows at a high mass flow rate. A branch line branches off upstream of the valve and includes a check valve and a pressure vessel upstream of the check valve. The ram valve is constructed to have an elongated valve housing and a movable valve body therein, slidable axially in the direction of flow, and shaped to provide for smooth fluid flow therethrough when open and forming a smoothly continuous decreasing flow cross-sectional area. The valve body is held open by an adjustable force, such as a spring or a magnet. When the force is exceeded, the valve body closes suddenly, causing a pressure pulse to be transmitted through the then open check valve into the branch pressure vessel to build up pressure therein. A closed supply pressure vessel having an air cushion is included in the inlet supply line to the valve. The pressure vessels, the supply line, the ram valve and the check valve are a unitary assembly capable of installation and transportation as a unit, the inlet supply line preferably being formed as a spiral coil surrounding the branch pressure vessel and terminating in a tangential outflow to decrease flow turbulence to the valve.

22 Claims, 4 Drawing Figures

HYDRAULIC RAM VALVE UNIT

The present invention relates to a hydraulic ram, and more particularly to a hydraulic ram unit including a special hydraulic ram pump.

Hydraulic rams are customarily constructed individually to meet the special requirements of the respective installation. Water, typically, is continuously supplied to the unit usually under gravity flow. Upon sudden interruption of the flow, a pressure transient will build up which is utilized to convert the dynamic energy of the flowing water to a static pressure head. Usually, a supply line is provided in which a rapid-closing valve is located. Upstream of the supply line is a pressure vessel, typically a vessel with an air cushion, connected to the supply line by means of a check valve. The water, under pressure, is removed from the pressure vessel. Upon sudden closing of the valve which, customarily, is a flap valve, pressure will build up in the pressure vessel. Such pumps have only low efficiency and it was customary to fit each pumping installation individually to the specific topographical condition with which the pump was to be used. It was customary to connect the water supply line supplying water at high flow rates directly to the interrupting valve.

It is an object of the present invention to improve the efficiency of hydraulic ram valve units and, additionally, to so construct the unit that it can be manufactured in serial, mass production without matching components to individual installations, so that any one pumping construction can be used with installations having different water supply conditions, such as mass flow rate and pressure, as well as different pumping requirements, such as output pressure, and without changing the basic construction of the pump itself.

SUBJECT MATTER OF THE PRESENT INVENTION

Briefly, the valve has an elongated valve housing in which a longitudinally movable valve body is located, preferably of conical or drop shape, with the point of the cone, or the teardrop upstream of the valve housing. The valve housing is shaped to provide for smooth fluid flow therethrough, and the valve body, when the valve is open, is so matched to the housing that it forms, in the direction of flow, a smoothly and continuously decreasing flow cross-sectional area. The relative axial position of the valve body in the housing is adjustable, for example by stops coupled to a valve operating rod. Typically, the valve body is biassed by a force, such as a spring or a magnet, to open position counter the pressure exerted by fluid flow through the continuously constricting flow cross-sectional area. A second pressure vessel, with an air cushion, is located in the supply line of the supply water to the valve.

The efficiency of operation of hydraulic ram units of this type is greatly increased, and the pressure output available from the pump is improved. This permits lifting water to greater heights above the pump installation. The arrangement is compact and can be installed in locations which are otherwise difficult to utilize or where access is impeded. Pump units can be prefabricated, ready for installation to a supply line supplying water, to a drain connection and to a pressure outlet; installation of such pump units thus does not require special knowledge or skilled labor. The pump valve element itself can readily be adjusted so that the pump unit can be matched to various operating or operation parameters, for example to installations in which the water supply varies widely. The unit is simple, has few moving parts subject to wear and tear, so that it can operate for long periods of time without maintenance. The pump is self-starting, and will restart automatically, for example after interruption of water supply from the supply line. It does not require external priming.

The invention will be described by way of example with reference to the accompanying drawings, wherein.

Figure 1:
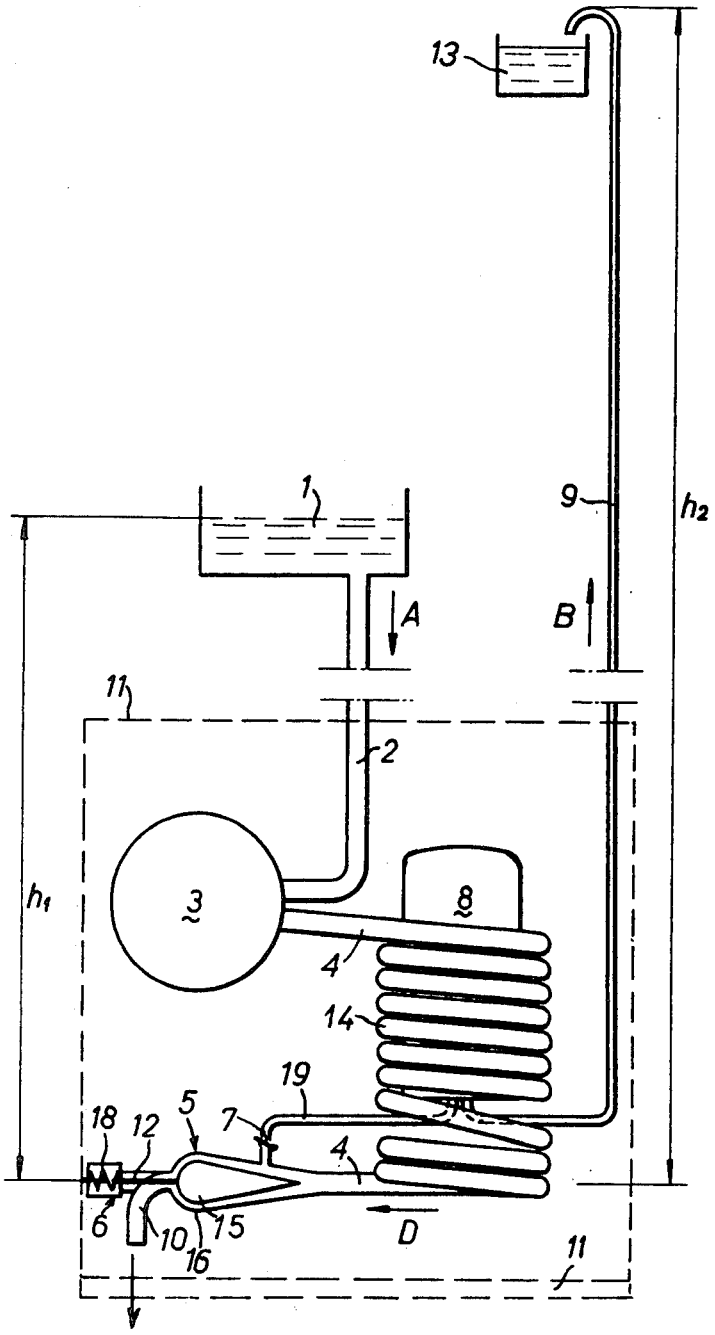
FIG. 1 is an overall schematic diagram of the pump unit in a hydraulic ram installation.

A main water supply 1 (FIG. 1) which may, for example, be a river, a dammed lake, or the like, supplies water through an inlet supply line 2 to a pressure vessel 3, at a lower elevation. Pressure vessel 3 is a closed vessel and has an air cushion. The quantity of water continuously available from source 1 and the height difference *h*1 determines the maximum output pressure indicated by the pumping height *h*2.

The supply pressure vessel 3 is connected to a supply line 4 through which water flows in the direction of the arrow D to the valve 5. The valve 5 is a rapidly operating ON-OFF valve. When valve 5 is open, water flows through the valve to a drain connection 10 from which the water can freely flow out. A branch line 19 in which a check valve 7 is included branches off the upstream side of supply line 4, for example from the valve housing 5 itself. Line 19 has a smaller diameter than the supply line 4. Check valve 7 opens when the pressure in the line 4 is at least as great as the pressure within a second or branch pressure vessel 8. The branch pressure vessel 8, like the supply pressure vessel 3, has an air cushion therein. Water is supplied under pressure having a pressure head *h*2 through output pressure line 9 from pressure vessel 8 to a utilization point 13, for example a water tank, a distribution line, or the like. In accordance with a feature of the invention, the valve housing and the valve body axially movable in the housing are so shaped relative to each other that, when the valve is open, a smoothly continuously decreasing or constricting flow cross-sectional area is provided for water flowing through the valve.

Operation: Let it be assumed that water flows in the direction of arrow D to valve 5. When the water reaches a predetermined speed, valve 5 will suddenly close by movement of the valve body to the left (FIG. 1) counter a reset force provided by spring 18. The sudden closing of the valve 5 causes a hydraulic pressure transient within line 4, which propagates through the branch line 19 into the second branch vessel 8. Check valve 7 will open when the pressure in line 4 is at least equal to the pressure within the branch vessel 8. As soon as this pressure is reached, check valve 7 permits water to flow through line 19 into the branch pressure vessel 8. Check valve 7 can be of conventional construction. Water will collect in the lower portion of the branch vessel 8, whereas the upper portion will have an air cushion, under pressure, arise therein. Water is withdrawn from the pressure vessel 8 through the riser 9 to a utilization point, for example a water supply 13, a reservoir, a distribution system, or the like. After a relatively short time, the water column in line 4 will oscillate back and pressure will be relieved at the valve 5, that is, a pressure of negative amplitude will arise thereat. The movable valve element of valve 5 will open. Simultaneously, check valve 7 will close and prevent that water can flow back from line 19 to the ON-OFF valve 5. The water column, oscillating back and forth in the supply line 4, again flows towards the outlet 10, since valve 5 is again open. When the flow rate exerts enough pressure to overcome the counter force, valve 5 will again close and the cycle will repeat.

It is important that the pressure pulse in the supply line 4 be sharp and have a high amplitude. To obtain such a sharp pressure wave, certain minimum dimensions are necessary regarding the length and diameter of the supply line 4. In order to still permit compact construction, the supply line 4 is formed as a spiral 14 wound about the second or branch vessel 8. Supply line 4 connects in tangential direction to both the inlet as well as the outlet of spiral 14 so that propagation of the pressure pulse is not impeded.

The pump unit including the supply line 4, the supply pressure vessel 3, the branch pressure vessel 8, the valve 5 and the check valve 7 can be assembled together as one single unitary assembly, ready for transportation and installation as one unitary element. The entire assembly can be secured to a base support plate 11 for transportation to a desired location, prefabricated and preconnected by the manufacturer. It is only necessary to connect the inlet supply duct 2, the riser pressure outlet 9, and to provide for a drain 10. The unitary assembly is shown in FIG. 1 included in a broken line. It can be shipped, ready for installation and connection, complete with connecting flanges, and does not require assembly of different elements at any location in which the various components are individually matched to water supply conditions, pressure differences, differences in elevation, and various lengths of lines or piping.

Figure 2:
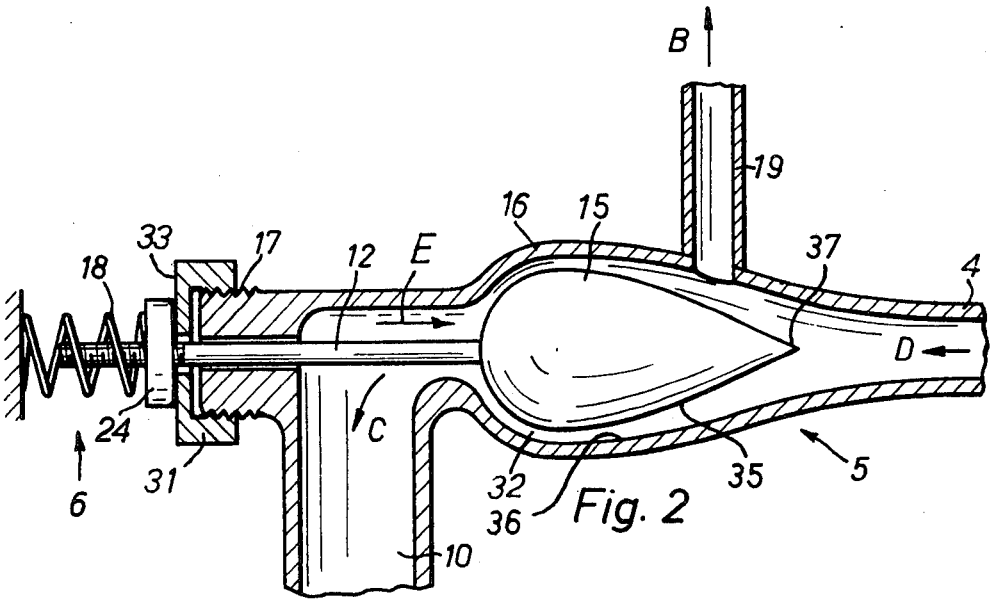
FIG. 2 is a longitudinal cross-sectional view through the valve element.

The valve 5 (FIG. 2) is formed as a valve housing body 16 in which a valve body 15 is located. The valve housing 16 itself can be an enlargement within the inlet line 4. The valve body 15 is streamlined, for example, of teardrop shape or conical; a teardrop shape, as shown in FIG. 2, is preferred. The valve body 15 is mounted for axial longitudinal movement within housing 16, coaxially with respect to the inlet line 4 which is tangentially connected to the spiral 14 (FIG. 1) downstream thereof. The valve body 15, when in open condition, is shaped with respect to the surrounding housing 16 to provide, in cross section, two smoothly converging surfaces 35, 36 which form, in axial direction, a converging constriction. The smoothly constricting surfaces, as referred to in this specification, are deemed to be surfaces in which there is continuous transition from a smaller diameter to a larger diameter, without abrupt steps, in contrast to flap-type valves. The cross-sectional area through which fluid flow can take place thus continuously decreases from the tip 37 of the valve body 15 to the narrowest zone 32. The subsequent portion of the inner surface of housing 16, as well as the outer surface of body 15 are approximately semicircular or, rather, semispherical and so shaped that the turbulence of resulting flow around the body 15 is as low as possible.

Valve body 15 is connected to a valve rod 12 which has a threaded end. An abutment washer 24 is threaded on the end of rod 12. A spring 18 bears against washer 24.

When the valve is open, as shown in FIG. 2, the force due to the speed of flow of water in the direction of the arrow D which acts on the valve body 15 will continuously increase until the reset or counter force of spring 18 is exceeded. At this point, body 15 will suddenly and rapidly move to the left (FIG. 2). The valve slams shut. A tight valve seat will form between the inner surface of housing 16 and the outer surface of valve body 15. Valve body 15 could also be replaced by a ball or a cone.

Rod 12 holds valve body 15 coaxially within the housing 16. Rod 12 is slidable in the housing and is connected to an adjustment arrangement 6 which permits changing the width of the gap 32 and the spring force acting on body 15. A threaded bushing 31 is screwed to an outer thread 17 formed on housing 16. In the open position, the washer 24, threaded on the terminal end of rod 12, abuts the bushing 33. By changing the position of bushing 33, the quiescent or open position of the valve body 15 with respect to the housing 16 can be changed, thus changing the width of the gap 32 and hence the speed of the water flowing through this gap, which causes closing of the valve.

When the valve 5 is open, water flowing in the direction of arrow D flows through the ring-shaped gap 32 between valve body 15 and the interior surface 36 of the housing 16. It then flows still in the direction of the valve and thereafter at right angles along arrow C to drain freely from drain connection 10. Drain connection 10 must be at a lower point than the water supply source 1. Upon closing of valve body 15 against the interior of housing 16, since the forces acting on valve body 15 are greater than the counter or reset force of spring 18, a sudden pressure pulse or pressure wave will result upstream in line 4 due to the sudden closing of water flow, which pressure wave is so great that it causes check valve 7 to open and water will flow out in direction of the arrow B into the branch line 19. Branch line 19 preferably terminates in the inlet line 4, or the valve housing 16 adjacent the tip 37 of the valve 15, when the valve is closed, or somewhat upstream or downstream thereof and, for example, branches off at essentially right angles therefrom (see FIG. 2).

Figure 3:
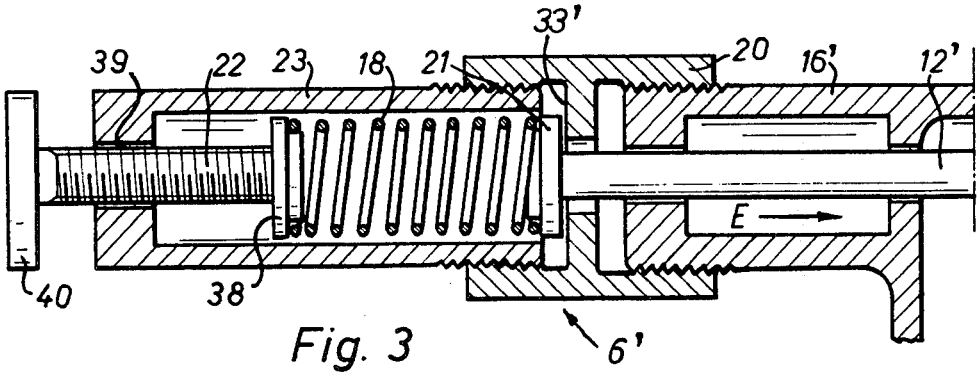
FIG. 3 is a fragmentary view, illustrating an embodiment in which reset force is provided by an adjustable spring.

Various arrangements to adjust the width of the gap 32 and the reset force E of spring 18 are possible. FIG. 3 illustrates an adjustment arrangement 6'; the remainder of the pump unit, as well as of the pump housing and pump body are similar to those of FIG. 2.

A coupling sleeve 20 is screwed to the rear portion of the housing 16'. A sleeve 23 is screwed into coupling 20. The rear end of rod 12' connected to the valve body is formed with a head 21 which forms an abutment at one side and, at the other, simultaneously forms a bearing surface for spring 18. The opposite end of spring 18 is placed against a disk 38 secured to a threaded rod 22. The position of threaded rod 22 is adjustable within sleeve 23 by rotating threaded rod 22 in the thread connection 39 by hand wheel 40. Thus, the bias force E of spring 18 can be changed so that the reset force acting on the valve body 15 in the direction of the arrow E can be adjusted. In the open position of valve body 15, head 21 engages the radial surface 33' of the coupling 20. By changing the position of the coupling 20 on the housing 16', the axial position of the valve body 15 with respect to the housing can be changed, so that the width of the gap 32 can be adjusted independently of the reset spring force acting in direction of arrow E.

Figure 4:
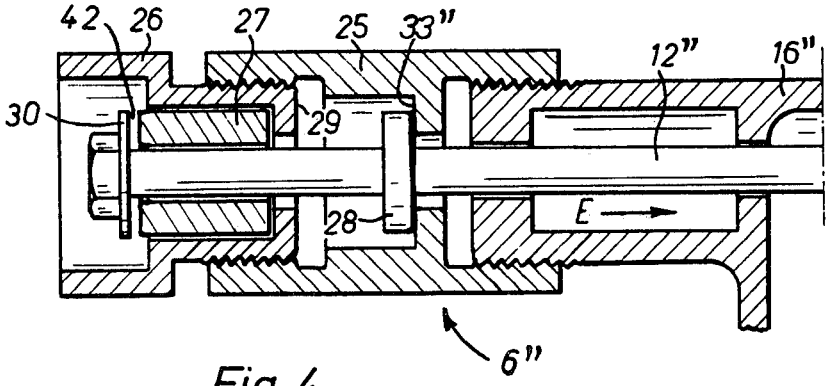
FIG. 4 is a fragmentary view of the valve in which the reset force is provided by a magnet, and illustrating adjustment of the reset force.

The reset force can be obtained in different ways; FIG. 4 illustrates a magnet 27 located within a sleeve 26. The rear end of rod 12", connected to valve body 15, has an armature disk 30 of soft iron secured thereto. The permanent magnet 27 thus exerts a force on disk 30 in the direction of the arrow E, which increases with decreasing distance of disk 30 from the magnet 27. The width of the air gap 42, and thus the stroke of the valve body 15 can be adjusted by threading sleeve 26 into coupling 25. Coupling 25 is threaded on the rear end of housing 16", and sleeve 26, in turn, is threaded into coupling 25. The permanent magnet 27 is rigidly secured in sleeve 26. A ring-shaped abutment collar 28 is located on operating rod 12", engaging a radial surface 33" within sleeve 25 when the valve body 15 is in open position. The width of the gap 32 between the valve body 15 and the housing 16 thus can be adjusted by screwing the coupling 25 more or less on housing 16"; the force can be adjusted by changing the air gap 42, for example by moving the soft-iron armature washer 30 axially along the rod 12".

A small pump embodying the present invention had the following characteristics:

supply water drop $h1=15$ m
length of supply line 4=20 m
diameter of supply line 4=2 cm
riser height $h2=60$ m
supply capacity of water supply=20 liters/min
output flow=4 liters/min.

The foregoing data are merely an example and are not to be deemed to limit the invention thereto. If sufficient supply water is available, a plurality of valves 5 can be connected in parallel.

Valve housing 16 and valve body 15 are preferably made of different materials, for example stainless steel and bronze, respectively. The sealing surface then will be a purely metallic seal, eliminating rubber, plastic, or other soft seals.

The operating rod 12 should be freely movable, and need not be specially sealed since, in open condition, water flows through the valve and can drain immediately therebeyond; when the valve snaps shut, rod 12 is sealed from the water supply by the valve action itself. To prevent undesired drips, the element can be enclosed in a catch boot.

Various changes and modifications may be made and features described in connection with any one of the embodiments may be applied to any of the others, within the scope of the inventive concept.

I claim:

1. Hydraulic ram valve unit comprising a supply line (4), a ram valve (5) in the supply line, a branch line (19) branching upstream from the valve (5), a branch pressure vessel (8) connected to the branch line (19) to supply fluid under pressure to a pressure supply riser and a check valve (7) in the branch line (7) preventing back flow from the branch pressure vessel (8) to the ram valve (5);

the ram valve (5) including an elongated valve housing (16) and a movable valve body (15) in the housing, the valve housing being shaped to provide for smooth fluid flow therethrough, the valve body (15) being movable in a direction of its longitudinal axis, the valve body (15) and the valve housing (16) being relatively shaped to form, between the inner surface (36) of the valve housing (16) and the outer surface (35) of the valve body (15), in the direction of flow and when the valve is open, a gradually constricting gap (32), of smoothly continuously decreasing flow cross-sectional area and, when the valve is closed, to form a valve seat downstream of said gap (32) to close fluid communication through said ram valve (5), means (6; 20, 25, 31) coupled to the valve body (15) to adjust the relative axial travel of the valve body (15) in the housing (16) away from said valve seat and to form said gap (32), force means (18, 27) acting on and biassing the valve (15) to open position counter the pressure exerted by fluid flow through the continuously constricting flow cross-sectional area;

and a closed supply pressure vessel (3) having an air cushion therein connected upstream of the valve (5) in the supply line (4) and between the source (1, 2) of the fluid.

2. Valve unit according to claim 1, wherein the branch pressure vessel (8), the supply pressure vessel (3), the supply line (4), the ram valve (5) and the check valve (7) comprise a unitary assembly capable of installation and transportation as a unit.

3. Valve unit according to claim 1, wherein the branch pressure vessel (8) is essentially cylindrical and the supply line (4) is wound about the branch pressure vessel (8) in form of a spiral (14).

4. Valve unit according to claim 1, wherein the movable valve body has streamlined configuration, and wherein the downstream shape of the movable valve body (15) and the valve housing (16) have matching surfaces forming said valve seat.

5. Valve unit according to claim 4, wherein the movable valve body has tear-drop shape.

6. Valve unit according to claim 4, wherein the movable valve body has conical shape.

7. Valve unit according to claim 4, wherein the movable valve body has ball shape.

8. Valve unit according to claim 1, wherein the means adjusting the travel of the valve body (15) comprises an operating rod (12) secured to the movable valve body (15), extending coaxially with respect thereto and with respect to the housing (16);

and an adjustable stop element (24) located on the operating rod (12) to adjust the gap (32) formed by the continuously decreasing flow cross-sectional area between the valve body (15) and the valve housing, when the valve is in open condition.

9. Valve unit according to claim 8, wherein a drain line downstream of the valve body, when the valve is closed, includes a portion which is coaxial with the operating rod.

10. Valve unit according to claim 1, wherein the bias force means comprise a spring (18) providing said bias force and acting in direction (E) to bias the valve body to open position;

and means (22, 24) to adjust the biassing force exerted by the spring (18) against the valve body.

11. Valve unit according to claim 1, wherein the bias force means comprise (FIG. 4) a magnet element (27) and an armature element (30) having soft-iron characteristics and movable relative to each other, one of said elements being coupled to the valve body (15) to provide a biassing force thereto to maintain the valve body in open position by interaction with the other element.

12. Valve unit according to claim 11, wherein the magnet element (27) is secured on the valve housing (16) and the armature element (30) is coupled to the valve body (15).

13. Valve unit according to claim 12, further comprising a sleeve (26) formed with an opening therethrough and retaining the magnet element on the housing (16);

and on operating rod (12″) secured to the armature (30) and connected to the valve body (15).

14. Valve unit according to claim 1, wherein the branch pressure vessel (8) is essentially cylindrical; the supply line (4) is looped around said vessel to form a looped portion (14), the connection to as well as from the looped portion being in tangential direction, the ram valve (5) being located downstream of the looped portion (14);

and the branch line (19) including the check valve (7) branches off the supply line downstream from the looped portion.

15. Valve unit according to claim 1, wherein the relative shape of the inner surface (36) of the valve housing (16) and the outer surface (35) of the valve body (15), when the valve is open, forms, downstream from said gap (32), a flow area of increasing cross section.

16. Valve unit according to claim 1, wherein the valve housing (16) and the valve body (15) are formed of different metals, and provide a sealing valve seat formed only by contacting engagement of said different metals of the housing and valve body.

17. Valve unit according to claim 1, wherein the valve housing (16) and the terminal portion of the supply line (4) connected thereto are coaxial.

18. Valve unit according to claim 1, wherein the valve body is of stream-lined, tear-drop shape and the branch line (19) branches off in the region of the tip (37) of the valve body (15) when the ram valve (5) is closed.

19. Hydraulic ram valve unit assembly comprising the hydraulic ram valve unit of claim 1 the branch pressure vessel (8), the supply pressure vessel (3), the supply line (4), the ram valve (5) and the check valve (7) being secured to a support and forming therewith a unitary assembly capable of installation and transportation as a unit;

and wherein further the valve body (15) is of streamlined form;

the adjustment means (6) include an operating rod (12) coupled to the valve body (16) adjusting the width of the gap (32) formed by the continuously decreasing flow cross-sectional area when the valve is in open condition and the force of said force means being adjustable to adjust the bias force biassing the valve body to open position.

20. Ram valve unit assembly according to claim 19, wherein the branch pressure vessel (8) is at least in part cylindrical and the supply line (4) is looped around said cylindrical part to form a looped portion (14), the inlet and outlet connections of said looped portion extending essentially tangentially with respect thereto.

21. Ram valve unit according to claim 20, wherein the valve body is of streamlined, tear-drop shape and the branch line (19) branches off in the region of the tip (37) of the valve body (15) when the valve is closed.

22. Ram valve unit according to claim 19, wherein the valve body is ball-shaped, and the branch line (19) branches off the supply line in the region of the valve housing approximately even with the upstream end (37) of the movable valve body.

* * * * *